United States Patent [19]

Boschet

[11] 4,161,358

[45] Jul. 17, 1979

[54] SHEET SUPPORTING DRUM DURING DEVELOPMENT IN MACHINES FOR ELECTROSTATICALLY PREPARING PRINTING MATRICES

[75] Inventor: Vittorino Boschet, Milan, Italy

[73] Assignee: Grafosol, S.p.A., Milan, Italy

[21] Appl. No.: 872,487

[22] Filed: Jan. 26, 1978

[30] Foreign Application Priority Data

Feb. 1, 1977 [IT] Italy ..... 20545/77[U]

[51] Int. Cl.[2] ..... G03G 15/00

[52] U.S. Cl. ..... 355/3 DR; 101/415.1

[58] Field of Search ..... 355/3 DR, 16, 3 SH; 101/415.1

[56] References Cited

U.S. PATENT DOCUMENTS

| | | | |
|---|---|---|---|
| 3,348,288 | 10/1967 | Tanguay et al. | 101/415.1 X |
| 3,839,961 | 10/1974 | Murata | 101/415.1 X |
| 4,056,829 | 11/1977 | Ikeda | 101/415.1 X |

FOREIGN PATENT DOCUMENTS

| | | | |
|---|---|---|---|
| 2461324 | 7/1975 | Fed. Rep. of Germany | 355/3 DR |
| 2526173 | 1/1976 | Fed. Rep. of Germany | 355/3 DR |
| 2707694 | 1/1977 | Fed. Rep. of Germany | 355/3 DR |

*Primary Examiner*—R. L. Moses

*Attorney, Agent, or Firm*—Steinberg & Blake

[57] ABSTRACT

A sheet supporting drum during development in machines for electrostatically preparing printing matrices is disclosed. The drum is provided with front or head and rear or tail grippers, of which the rear or tail gripper is displaceable, wherein the latter comprises a fillet or section carried by arms passing through slots in the drum shell and mounted on a rotable common shaft carried by bearing means that can be angularly displaced about an axis coincident with the drum axis of rotation.

3 Claims, 3 Drawing Figures

SHEET SUPPORTING DRUM DURING DEVELOPMENT IN MACHINES FOR ELECTROSTATICALLY PREPARING PRINTING MATRICES

This invention relates to a sheet supporting drum during development of the latent image on the sheet, which drum is intended to be used in machines electrostatically preparing printing matrices.

Machines are known for electrostatically preparing printing matrices, wherein the metal or paper sheet which will constitute the printing matrix, after being electrostatically charged and exposed, is caused to adhere to a surface of a rotable drum, being retained thereat by grippers clamping the front and rear edges of the sheet. Since the sizes of the sheet may be different, one of these machines has a drum in which the rear or tail gripper(s) may be moved along the drum shell. However, this known approach involves that, in account of the substantial overall radial dimensions of the rear or tail gripper, the magnetic cylinder supplying the toner on the sheet for "developing" the latent image is carried by a device so that it can be moved away from the drum when said rear or tail gripper passes in front of it. This results in a heavy expense due to the provision of the removing mechanism.

It is the object of the present invention to provide a drum of more convenient and useful application, allowing the required removing mechanism of the magnetic cylinder to be dispensed with.

In order to achieve this object, in addition to further objects which will become more apparent from the following detailed description, the invention proposes a drum having a rear or tail gripper which is adjustable according to the sheet size, the drum being essentially characterized in that said rear or tail gripper comprises a fillet or section carried by arms passing through slots in the drum shell and which are mounted on a rotable common shaft carried by a bearing that can be angularly moved about an axis coincident with the drum axis of rotation.

The invention will be more clearly understood from the following detailed description, given by mere way of indication and with reference to the accompanying drawings, in which.

Figure 1:
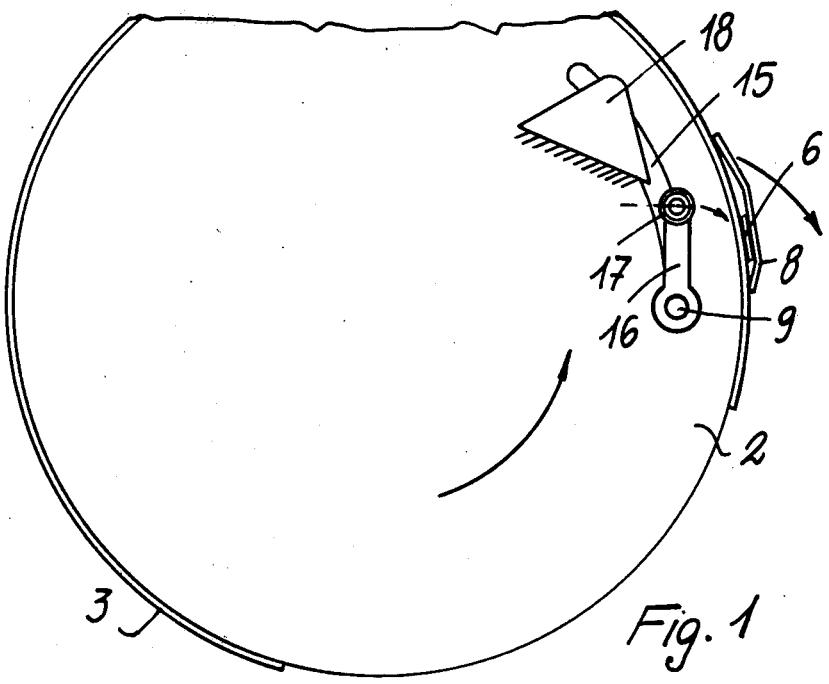
FIG. 1 is a side elevational view of the drum.
Figure 2:
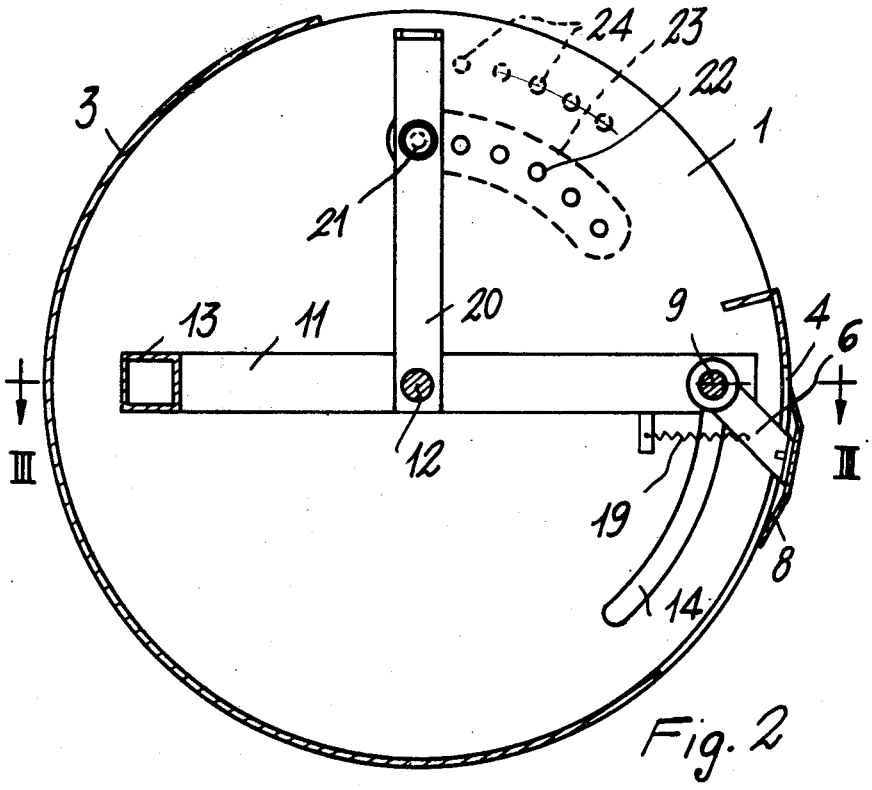
FIG. 2 is a cross-sectional view of the drum taken along line II—II of FIG. 3.
Figure 3:
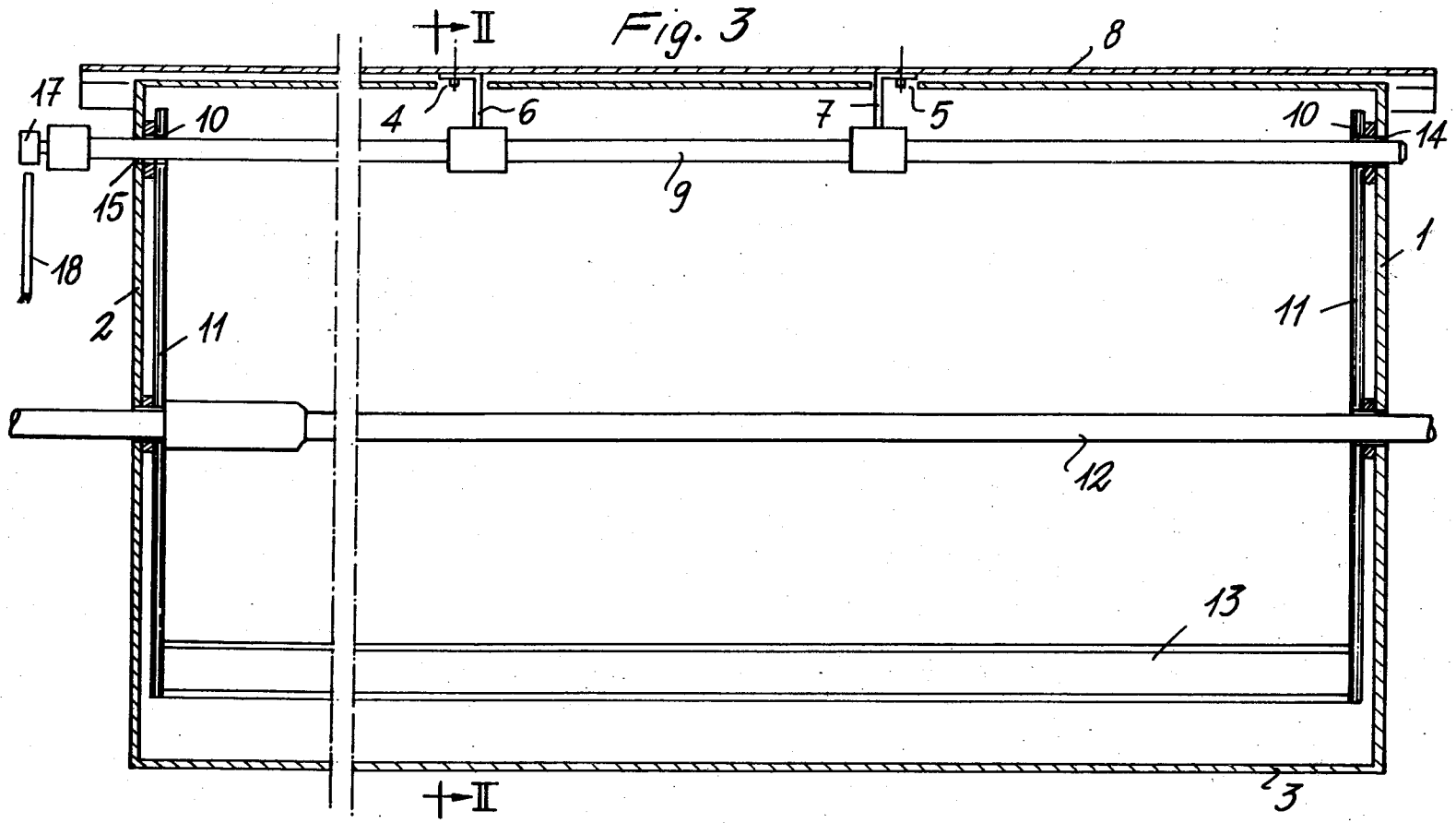
FIG. 3 is a longitudinal sectional view of the drum taken along line III—III of FIG. 2.

Referring to the figures of the accompanying drawings, the drum comprises two end discs 1 and 2 and a shell 3 which is interrupted or discontinued for a large angular extension.

Two peripheral parallel slots 4 and 5 are provided in said shell and have arms 6 and 7 passing therethrough, while a fillet or section 8 is attached to the bent end of these arms. Arms 6 and 7 are secured to a shaft 9, which is rotably carried at bearings 10 by two spokes 11, rotably mounted on the operation shaft 12 of the drum and interconnected by a cross piece or tie 13.

The two ends of shaft 9 project from discs 1 and 2 through arcuate slots 14 and 15. A lever 16 is secured to one of said ends and has a roller 17 intended to cooperate with a fixed cam 18 for opening the rear or tail gripper which, as appreciated, comprises said fillet 8 and members connected thereto. Of course, the trailing edge of the sheet will be clamped between said fillet 8 and drum shell 3.

The gripper is held adherent to the shell by one or more springs, such as that shown at 19.

In order to adjust the position of the rear or tail gripper along said slots 4 and 5, and accordingly accomodate it to the length of the sheet which is retained on the shell during the development of the latent image, provision is made that one of said spokes 11 should be fast with a lever 20 having a threaded bush or sleeve, in which a setscrew 21 can be screwed down as inserted from outside in one of holes 22 in said disc 1. More particularly, adjustment is effected by manually moving the lever 20 through the interruption or discontinuity of shell 3 to align bush or sleeve with the preselected hole of said holes 22 and then screwing down said setscrew from the outside. This expedient may be replaced by another, for example by an expedient in which in lieu of said bush or sleeve 21 there is provided an arm projecting from disc 1 through a slot 23. The arm carries a handle movable against a spring and provided with a pin for insertion in one of holes 24 in disc 1.

The front or head gripper has not been shown on the drawings because of not being the subject of the present invention or model and may correspond to that in use of the prior art drums.

What is claimed is:

1. A sheet supporting drum for use during development of a latent image in machines for electrostatically preparing printing matrices, provided with front and rear grippers, for retaining said sheet in its proper position on the drum surface of which the rear gripper is angularly displaceable over the drum surface, wherein said rear gripper comprises a fillet carried by arms passing through slots in the drum shell and mounted on a rotatable common shaft carried by bearing means, said common shaft being adapted to be angularly displaced about an axis coincident with the drum axis of rotation.

2. A drum according to claim 1, wherein said slots are peripheral.

3. A drum according to claim 1 wherein the rotatable common shaft is connected to a control lever.

* * * * *